US008360947B2

(12) United States Patent
Eusepi et al.

(10) Patent No.: US 8,360,947 B2
(45) Date of Patent: Jan. 29, 2013

(54) TWIN TRACK MACHINE AND A METHOD FOR MANUFACTURING COMPOSITE FILTERS ATTACHABLE TO CIGARETTES, CIGARS AND THE LIKE

(75) Inventors: Ivan Eusepi, Castelmaggiore (IT); Umberto Zanetti, Modena (IT)

(73) Assignee: G.D S.p.A., Bologna (IT)

( * ) Notice: Subject to any disclaimer, the term of this patent is extended or adjusted under 35 U.S.C. 154(b) by 270 days.

(21) Appl. No.: 12/851,960

(22) Filed: Aug. 6, 2010

(65) Prior Publication Data

US 2011/0034309 A1 Feb. 10, 2011

(30) Foreign Application Priority Data

Aug. 10, 2009 (IT) ..... BO2009A0542

(51) Int. Cl.
*B31C 99/00* (2009.01)

(52) U.S. Cl. ..... 493/39; 493/4; 493/45; 493/46; 493/941; 131/88

(58) Field of Classification Search ..... 493/4, 39, 493/45–50, 941; 131/84.1, 88, 282
See application file for complete search history.

(56) References Cited

U.S. PATENT DOCUMENTS 3,308,832 A * 3/1967 Stelzer et al. ..... 131/94
4,238,994 A * 12/1980 Koch ..... 493/4
4,301,816 A * 11/1981 Wahle et al. ..... 131/88
5,349,968 A * 9/1994 Rizzoli et al. ..... 131/94
2004/0237972 A1* 12/2004 Horn et al. ..... 131/88
2009/0145449 A1* 6/2009 Cieslikowski et al. ..... 131/280

FOREIGN PATENT DOCUMENTS

EP 1787534 1/2009

* cited by examiner

*Primary Examiner* — Thanh Truong
(74) *Attorney, Agent, or Firm* — Timothy J. Klima; Shuttleworth & Ingersoll, PLC

(57) ABSTRACT

A method of manufacturing composite filters for cigarettes, cigars and similar tobacco products, on a twin track machine, involves generating a succession of filter sticks of a first type, made from a first filter material and/or having first filtration properties, and at least one other succession of filter sticks of a different type, made from a respective different filter material and/or having filtration properties different to those of the first type; cross-cutting the filter sticks of the first type and the filter sticks of the different type on at least one transverse cutting line to obtain a succession of first and second plugs of the first type and a succession of first and second plugs of the different type; arranging the first plugs of the first type and the first plugs of the different type in alternation one with another to create a first filter rod, and arranging the second plugs of the first type and the second plugs of the different type in alternation one with another to create a second filter rod; checking the position of at least one first plug of the first rod, relative to a corresponding second plug of the second rod; and correcting the position of the at least one transverse cutting line according to the relative positioning of the first and second plugs.

12 Claims, 4 Drawing Sheets

TWIN TRACK MACHINE AND A METHOD FOR MANUFACTURING COMPOSITE FILTERS ATTACHABLE TO CIGARETTES, CIGARS AND THE LIKE

This application claims priority to Italian Patent Application BO2009A000542 filed Aug. 10, 2009, the entirety of which is incorporated by reference herein.

BACKGROUND OF THE INVENTION

The present invention relates to a twin track machine and to a method for manufacturing composite filters attachable to cigarettes, cigars and the like.

Reference is made explicitly to cigarettes in the following specification, albeit with no limitation in scope implied.

Conventionally, the harmful effects of inhaling cigarette smoke are reduced by tipping cigarettes with composite filters, that is to say with filters obtainable by pairing together two or more filter plugs made of material having different filtration properties, which are joined permanently together by being enveloped in a paper plugwrap.

The plugs of different type, or at all events with different filtration properties, are fed by respective trains of rollers to a common take-up and ordering conveyor, furnished with peripheral flutes.

Thus, each of the flutes in question accommodates a single composite filter element consisting in a group of two or more filter plugs having different properties, axially aligned and placed in end-to-end contact.

In twin track machines, to which the present invention relates, these composite filter elements are transferred to a garniture tongue on which two composite filter rods are fashioned.

More exactly, the two successions of filter elements are caused to advance along a direction parallel to their longitudinal axes, and enveloped in respective strips of paper material (plugwrap) to form continuous rods.

At the outfeed end of the garniture tongue, the continuous rods are divided up simultaneously by a single cutter device into a plurality of discrete filters.

To keep the two successions of filters aligned transversely one with another at the moment of the cut, conventional machines comprise means by which to correct the alignment.

In other words, a detection unit is placed in close proximity to the cutter device, such as will compare the positions of the corresponding plugs making up each group in the two rods, both in relation one to another and in relation to the cutter device.

In particular, should the corresponding plugs in the two rods be found to have drifted out of position one relative to another, the correction means aforementioned will be activated.

In one prior art method, the correction is made by adjusting the feed rate of at least one of the strips of paper plugwrap material, and consequently modifying the speed at which one of the two rods is assembled.

In other words, the correction means are designed to accelerate or decelerate the feed rate of the strip of paper material in such a way that the alignment error revealed by the detection unit is reduced to zero.

However, in the event that the misalignment is caused by a cumulative error, then the misalignment will be incremental. In this situation, the magnitude of the correction, which is proportional to the degree of misalignment, will be incremental likewise. Given that in conventional machines, the error is corrected by operating directly on the plugwrap material, the magnitude of the correction can become so great that there is considerable risk of the plugwrap material being broken.

In other words, if the misalignment is generated by a cumulative systematic error, the conventional machines in question are unable to reduce the misalignment to zero. In practice, the corrective action can be applied only to the point of inducing a break in the strip of plugwrap material.

Accordingly, the object of the invention is to overcome the drawbacks described above by providing a twin track machine and a method for manufacturing composite filters attachable to cigarettes, cigars and the like, designed to ensure that systematic and cumulative errors affecting the manufacture of such filters can be successfully corrected.

SUMMARY OF THE INVENTION

The stated object is realized, according to the present invention, in a twin track machine for manufacturing composite filters attachable to cigarettes, cigars and similar tobacco products, typically filters composed of at least two plugs made from different materials and/or with different filtration properties. Such a machine comprises first feed means by which filter sticks of a first type made from a first filter material are directed in succession along a respective first path; also second feed means by which filter sticks of a second type, made from a second filter material, are directed in succession along a respective second path; first cutting means positioned along the first path, by which each stick of the first type is cross-cut on at least one transverse cutting line and separated thus into first and second plugs, arranged alternately and end to end; the first plugs of the first type forming part of a first continuous filter rod and the second plugs of the first type forming part of a second continuous filter rod; second cutting means positioned along the second path, by which each stick of the second type is cross-cut on at least one transverse cutting line and separated thus into first and second plugs, arranged alternately and end to end; the first plugs of the second type forming part of the first filter rod and the second plugs of the second type forming part of the second filter rod; conveying and assembling means by which the first plugs of the first and second types are taken up, ordered and advanced longitudinally, end-to-end and in alternation, along the track on which the first filter rod is formed, and by which the second plugs of the first and second types are taken up, ordered and advanced longitudinally, end-to-end and in alternation, along the track on which the second filter rod is formed; control means monitoring the longitudinal position of at least one first plug of the first rod, and of the corresponding second plug of the second rod, one relative to another; and correction means by which the position of the transverse cutting line on the sticks of the first type, and/or the position of the transverse cutting line on the sticks of the second type, can be adjusted according to the relative positioning of the first and second plugs.

The stated object is realized likewise in a method of manufacturing composite filters according to the invention, which includes the steps of generating a succession of filter sticks of a first type, made from a first filter material, and a succession of filter sticks of a second type, made from a second material different to that of the first type; cross-cutting the sticks of the first type and the second type on at least one transverse cutting line to obtain a succession of first and second plugs of the first type and a succession of first and second plugs of the second type; arranging the first plugs of the first type and the first plugs of the second type alternately one with another to create a first filter rod, and arranging the second plugs of the first type and the second plugs of the second type alternately one with another to create a second filter rod; checking the position of at least one first plug of the first rod, relative to a corresponding second plug of the second rod; and correcting the position of the transverse cutting line according to the relative positioning of the first and second plugs.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
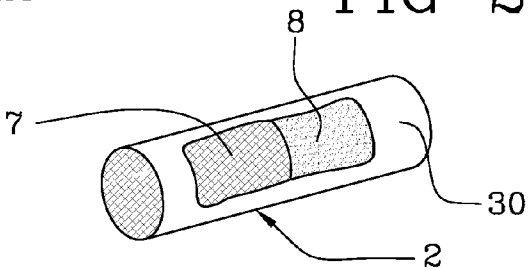
FIG. 2 shows a composite filter, viewed in perspective and with one part cut away for clarity.

With reference to the accompanying drawings, numeral 1 denotes a twin track machine, in its entirety, for manufacturing composite filters 2 (FIG. 2) attachable to cigarettes, cigars or other similar tobacco products. The machine 1 comprises a frame 3 and is equipped with an assembling unit 4, carried by a bulkhead 5 forming part of the frame 3.

The assembling unit 4 is able to prepare filter groups 6, each comprising two or more filter plugs made of different materials and/or having different filtration properties, axially aligned and placed in end-to-end contact one with another.

Figure 3:
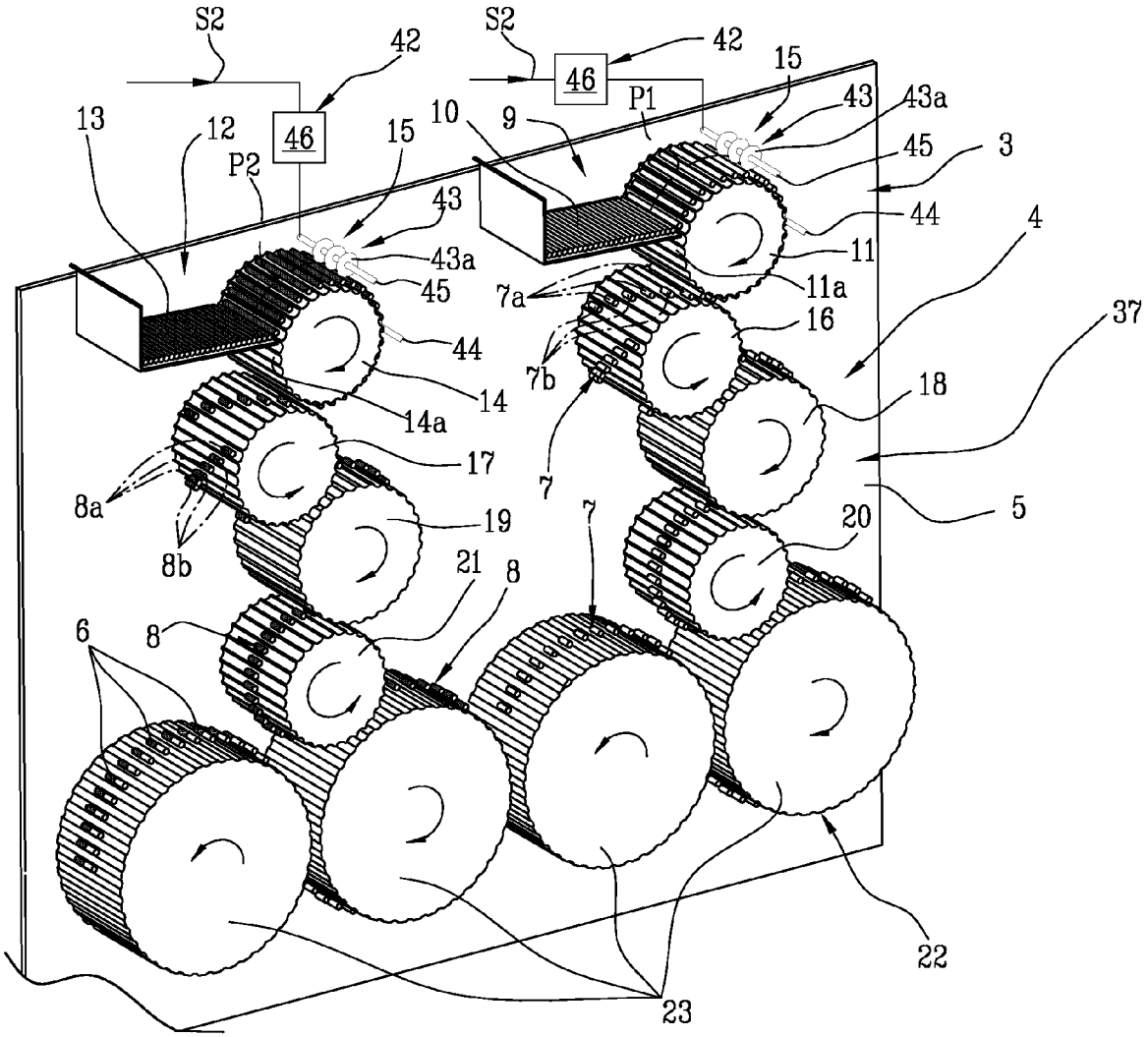
FIG. 3 shows a detail of the machine in FIG. 1, viewed in perspective.

In the example illustrated, and as indicated in FIG. 3, the groups 6 are made up of just two filter plugs with respective different filtration properties, denoted 7 and 8 respectively. Within the scope of the present invention, however, the groups could be made up of n filter plugs with different filtration properties, the number n being greater than or equal to two.

In detail, the machine comprises a first feed hopper 9 supplying a first succession of filter sticks 10 of a first type, made from a first filter material and/or with first filtration properties.

In the example illustrated, the filter sticks 10 of the first type are released from the first feed hopper 9 to a respective pick-up roller denoted 11.

In addition, the machine 1 comprises a second feed hopper 12 supplying a second succession of filter sticks 13 of a different type, made from a different filter material and/or with filtration properties dissimilar to the first type.

The expression "different type" will also be referred to hereinafter as "second type" or "further type".

In the example illustrated, the filter sticks 13 of the second or further type are released from the second feed hopper 12 to a respective pick-up roller denoted 14.

The first and second pick-up rollers 11 and 14 each present a plurality of flutes, denoted 11*a* and 14*a* respectively, extending parallel to the axes of rotation of the rollers. The successions of filter sticks 10 and 13 are cradled by the flutes 11*a* and 14*a* of the two rollers. The flutes 11*a* and 14*a* have aspirating surfaces, so that the sticks 10 and 13 can be conveyed easily and securely. Accordingly, suitable vacuum means (not illustrated) will be associated with the first pick-up roller 11 and the second pick-up roller 14.

The first pick-up roller 11 carries the filter sticks 10 of the first type, taken up in succession from the respective hopper 9, along a first feed path P1; similarly, the second pick-up roller 14 carries the filter sticks 13 of the second or further type, taken up in succession from the respective hopper 12, along a second feed path P2.

The machine 1 further comprises a first cutter 15 associated with the first pick-up roller 11, or in effect, positioned along the first feed path P1, by which each stick 10 of the first type is cross-cut on at least one transverse cutting line T. In particular, and as illustrated in FIGS. 6*a* to 6*d*, the filter sticks 10 of the first type are divided on at least one cutting line T into a first plug 7*a* and a second plug 7*b*, at least, and more generally into a plurality of first and second plugs 7*a* and 7*b* arranged alternately and placed end to end along the axis of the filter stick 10. As will become clear in due course, the first plugs 7*a* of the first type form part of a first continuous filter rod 26*a*, whilst the second plugs 7*b* of the first type form part of a second continuous filter rod 26*b*.

In like manner, the machine 1 further comprises a second cutter 15 associated with the second pick-up roller 14, or in effect positioned along the second feed path P2, by which each stick 13 of the second or further type is cross-cut on at least one transverse cutting line T. In particular, the filter sticks 13 of the second or further type are divided on at least one cutting line T into a first plug 8*a* and a second plug 8*b*, at least, and more generally into a plurality of first and second plugs 8*a* and 8*b* arranged alternately and placed end to end along the axis of the stick 13. As will become clear in due course, the first plugs 8*a* of the second or further type form part of the first continuous filter rod 26*a*, and the second plugs 8*b* of the second type form part of the second continuous filter rod 26*b*.

Figure 1:
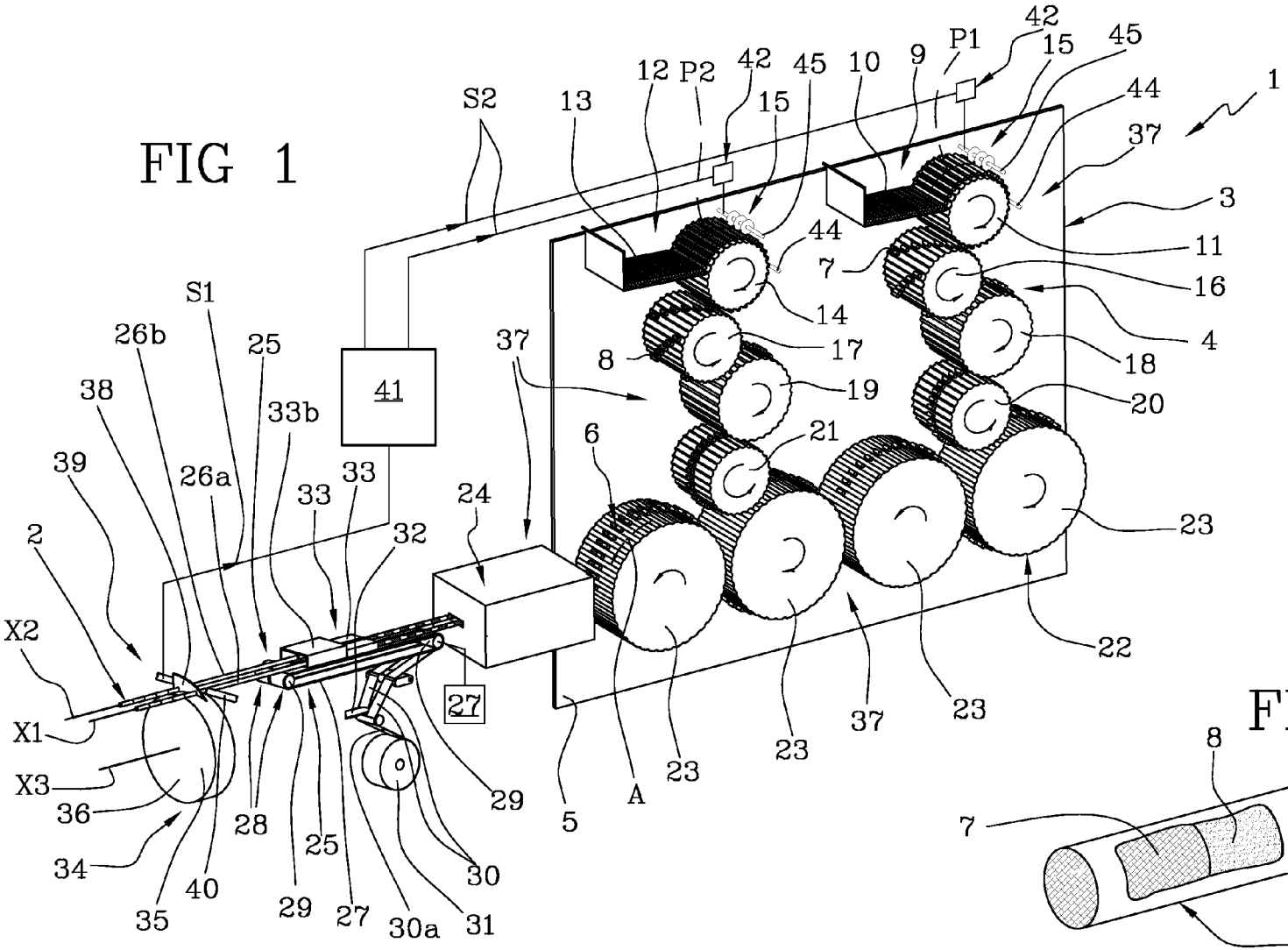
FIG. 1 shows a twin track machine according to the present invention for manufacturing composite filters attachable to cigarettes, cigars and the like, viewed schematically and in perspective.
Figure 4:
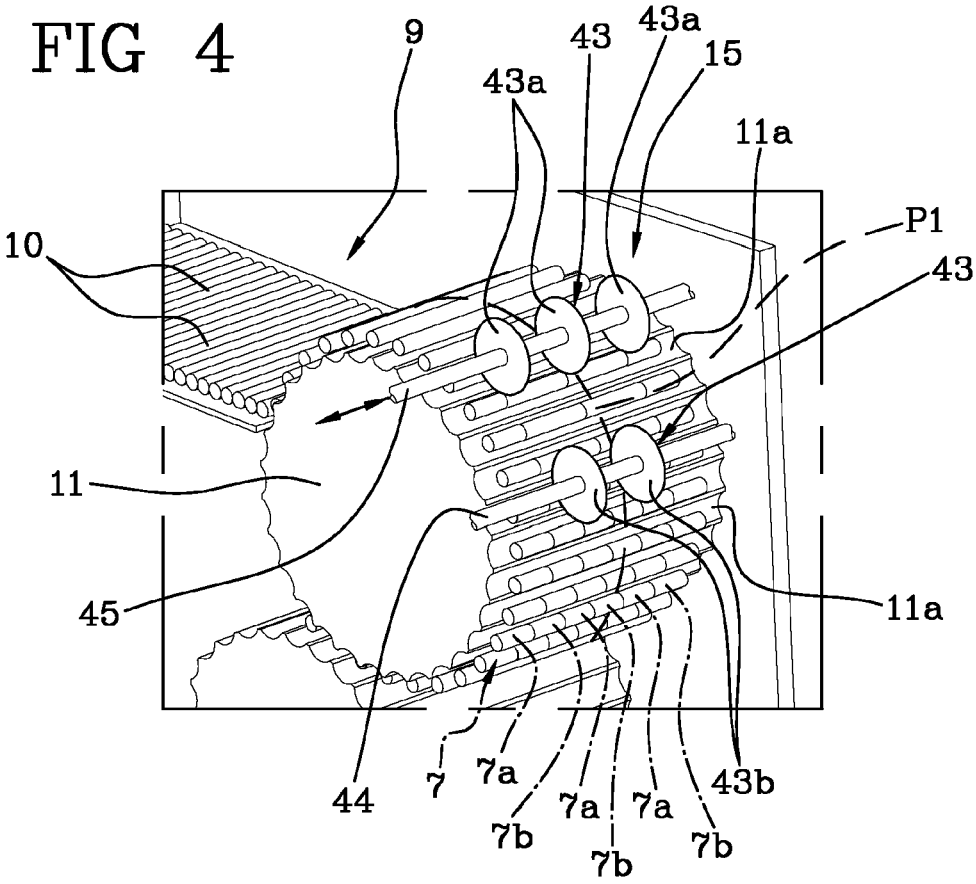
FIGS. 4 and 5 show a further detail of the machine in FIG. 1, viewed in perspective and illustrated in two different embodiments.
Figure 5:
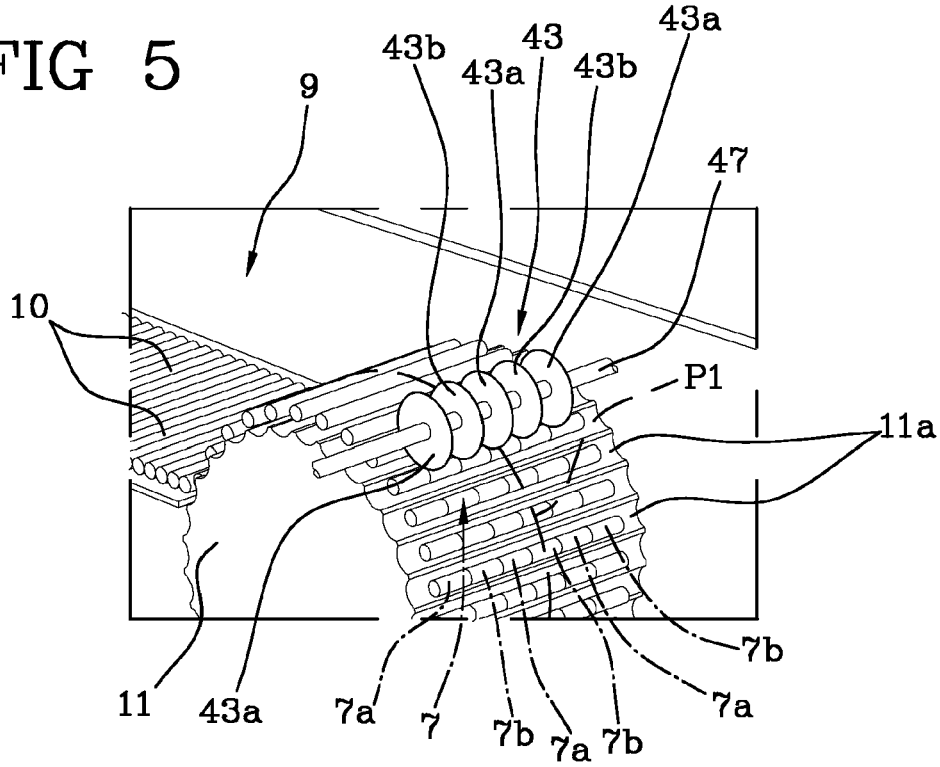

For example, as illustrated in FIGS. 1, 3 and 4, or in the alternative solution of FIG. 5, the cutter 15 positioned on the first path P1 divides the sticks 10 of the first type into six plugs 7, and more exactly into three first plugs 7*a* alternated with three second plugs 7*b*.

Similarly, the cutter 15 positioned on the second path P2 divides the sticks 13 of the second or further type into six plugs 8, and more exactly into three first plugs 8*a* alternated with three second plugs 8*b*.

The assembling unit 4, positioned immediately downstream of the cutters 15, comprises a first stagger roller 16 and a second stagger roller 17 associated respectively with the first pick-up roller 11 and with the second pick-up roller 14. The stagger rollers 16 and 17 operate in familiar fashion, not described here in detail, by taking up the plugs 7 and 8 in coaxial alignment from the respective pick-up rollers 11 and 14 and displacing them angularly, in ordered sequence, each staggered relative to the next, in such a way that the single plugs 7 and 8 lie parallel and offset one relative to another.

Operating downstream of the stagger rollers 16 and 17 are respective alignment rollers 18 and 19 operating in familiar fashion, not described here in detail, by which the plugs 7 and 8 are taken up in respective flutes, revolving in succession, and displaced axially along the selfsame flutes until brought into a position of alignment along the feed direction.

The unit 4 further comprises first and second transfer rollers 20 and 21 immediately downstream of the first and second alignment rollers 18 and 19, by which the columns of plugs 7 and 8 are released to an ordering conveyor 22.

In the example described and illustrated, the ordering conveyor 22 consists in a plurality of counter-rotating transport rollers 23 on which the plugs 7 and 8 are arranged as a succession of joined pairs advancing parallel one with the next.

In operation, the ordering conveyor 22 takes up the plugs 7 from the first transfer roller 20, and thereafter the plugs 8 from the second transfer roller 21, in such a way that each flute of the outfeed transport roller 23 will contain one first plug 7 and one second plug 8 joined axially one to another, or rather placed in end-to-end contact, and forming one aforementioned filter group 6.

In particular, first plugs 7*a* of the first type are placed in alignment and in end-to-end contact with first plugs 8*a* of the second or further type in flutes of the outfeed transport roller 23; these same flutes are alternated with flutes in which second plugs 7*b* of the first type are placed in alignment and in end-to-end contact with second plugs 8*b* of the second or further type.

Thus, the filter groups 6 are ordered on the conveyor 22, disposed parallel one with the next and advancing along a feed direction A that extends transversely to their individual longitudinal axes (FIG. 1).

The filter groups 6 thus prepared are directed onto a garniture tongue 25 of the machine presenting two parallel channels, or tracks, along which the first continuous filter rod 26*a* and the second continuous filter rod 26*b* are formed.

The two tracks follow respective longitudinal directions X1 and X2 extending parallel one with another.

Each filter rod 26*a* and 26*b* consists in a continuous succession of filter groups 6 aligned longitudinally and placed in end-to-end contact one with the next. To this end, the machine comprises orientation and transfer means 24 of familiar type, operating downstream of the assembling unit 4, by which the filter groups 6 are taken up and repositioned in such a way as to advance with their longitudinal axes aligned on the direction of the tracks.

The orientation and transfer means 24 are of the type described in patent EP 1787534, which is incorporated here by way of reference.

Importantly, the filter groups 6 are arranged by the orientation and transfer means 24 in alternation along the two channels or tracks of the garniture tongue 25.

Numeral 37 denotes the assembling unit 4 and the orientation and transfer means 24, considered in their entirety. In other words, numeral 37 denotes conveying and assembling means by which the first plugs 7*a* of the first type and the first plugs 8*a* of the at least second or further type are taken up, ordered and advanced longitudinally, end-to-end and in alternation, along the channel or track on which the first filter rod 26*a* is formed, and by which the second plugs 7*b* of the first type and the second plugs 8*b* of the second or further type are taken up, ordered and advanced longitudinally, end to end and in alternation, along the track on which the second filter rod 26*b* is formed.

Each channel of the garniture tongue is equipped with an electric motor 27 driving a looped belt or garniture tape 28 extending between two return pulleys 29, one at either end, as illustrated in FIG. 1.

A continuous strip of paper plugwrap material 30 is fed onto each tape 28 and thereupon caused to envelop the relative succession of filter groups 6.

Observing the preferred embodiment illustrated in FIG. 1, the garniture tongue is supplied with a single web of paper material 30*a*, decoiled from a single roll 31 and divided longitudinally by a knife 32 to create the two strips 30.

The successions of filter groups 6 are released by the orientation and transfer means 24 onto the paper strips 30 drawn forward by the garniture tapes 28.

Each garniture tape 28 carries the corresponding paper strip 30 and the relative filter groups 6 into a forming station 33, where the two paper strips 30 are wrapped progressively around the relative successions of filter groups 6 and secured in the manner of a sheath, thereby forming the first continuous filter rod 26*a* and the second continuous filter rod 26*b*.

The forming station 33, indicated schematically in FIG. 1, comprises a folding device 33*a* by which the continuous strip 30 is wrapped around the filter groups 6, and a gumming device 33*b* by which the longitudinal edges of the strip 30 are affixed one to another.

The first and second continuous filter rods 26*a* and 26*b* fashioned in this way are conveyed toward cutting means 34, preferably cyclical in operation, consisting in a cutter head 35 by which the selfsame first and second continuous rods 26*a* and 26*b* are separated into single composite filters 2, each consisting in one of the aforementioned filter groups 6 comprising at least two plugs 7 and 8.

In particular, the cutter head 35 comprises a rotating drum 36 set in motion, counterclockwise as viewed in FIG. 1, through the agency of a respective motor (not illustrated). The drum 36 rotates about an axis X3 inclined, in conventional manner, relative to the feed directions X1 and X2 followed by the continuous rods 26*a* and 26*b*, and presents a surface of revolution carrying two or more angularly equispaced knives 38.

Each knife 38 is angled, in conventional manner, relative to the feed directions X1 and X2 of the continuous rods 26*a* and 26*b*.

The composite filters 2 obtained in the manner described above are directed onto a further machine (a filter tip attachment machine), by which each composite filter 2 is joined to a respective cigarette stick.

In accordance with the present invention, the machine 1 further comprises control means 39 serving to monitor the longitudinal position of at least one first plug 7*a* or 8*a* of each of the filter groups 6 making up the first rod 26*a*, relative to a corresponding second plug 7*b* or 8*b* of each filter group 6 making up the second rod 26*b*.

In other words, the control means 39 are designed to verify and measure any transverse misalignment of the filter groups 6 making up one continuous rod, relative to the filter groups 6 making up the other continuous rod.

The control means 39 in question comprise at least two sensors 40, one monitoring each continuous filter rod 26*a* and 26*b*, capable of detecting the passage of at least one plug 7 and 8 in each group 6.

In particular, each sensor 40 reads the position of at least one filter plug 7 or 8 in the groups making up the first rod 26*a* or the second rod 26*b* and outputs a corresponding first signal S1 to a processing unit 41.

More exactly, this first signal S1 represents the extent of the transverse misalignment between the plugs 7 and 8 making up the two rods 26*a* and 26*b*.

The processing unit 41 pilots the operation of correction means 42 through a feedback loop, reacting to the relative longitudinal position aforementioned, so as to adjust the position of at least one transverse cutting line T on the filter sticks 10 of the first type and/or the position of at least one transverse cutting line T on the filter sticks 13 of the second or further type.

In short, the correction means 42 are associated with the control means 39 in such a way as to reposition at least one cutting line T according to the detected misalignment.

The processing unit 41 checks the first signal S1 received from the sensor 40 and, should there be a misalignment between the detected position of the filter plug 7 or 8 and its correct position, will output a second signal S2 indicating the measure of the correction required, piloting the operation of the cutters 15 by way of the feedback loop, through the agency of the correction means 42, to adjust the position of the cutting line T. In practice, the processing unit 41 will output a second signal S2 for each of the cutters 15.

To advantage, the first cutter 15 divides each successive stick 10 into an even number of first plugs 7*a* and second plugs 7*b*.

Similarly, the second cutter 15 divides each successive stick 13 into an even number of first plugs 8*a* and second plugs 8*b*.

According to the invention, the position of the cutting line T is corrected by introducing a change in the relative positioning between the cutters 15 and the first and second pick-up rollers 11 and 14. In the example illustrated, more exactly, the correction is made by changing the position of the cutters 15 relative to the first pick-up roller 11 and/or to the second pick-up roller 14.

In an alternative solution, not illustrated, the position of the cutting line could be corrected by displacing the filter sticks 10 and 13 relative to the cutters 15.

The displacement of the sticks 10 and 13 relative to the cutters might be accomplished, for example, using push rods of familiar type (not illustrated) associated with the hoppers 9 and 12, for example operating immediately upstream of the respective first and second pick-up rollers 11 and 14, such as will shift the sticks 10 and 13 through a given distance parallel to their own axes.

A further solution, likewise not illustrated, might be to displace the sticks 10 and 13 along the flutes 11*a* and 14*a* of the pick-up rollers 11 and 14, for example by rendering the flutes 11*a* and 14*a* capable of axial movement in a direction parallel to the axes of rotation of the respective pick-up rollers 11 and 14, or by pushing the sticks 10 and 13 along the flutes 11*a* and 14*a*.

Displacing the sticks 10 and 13, the cutters 15 and the respective blades 43 can preferably remain in position, or alternatively, move to accompany the displacement of the sticks 10 and 13.

To this end, each cutter 15 comprises at least one translating blade 43*a* associated respectively with the first pick-up roller 11 and with the second pick-up roller 14. The translating blade 43*a* is a rotary type, capable of dividing the filter sticks 10 and 13 into plugs 7 and 8.

A displacement of the translating blade 43*a* along the sticks 10 and/or 13 causes a displacement of the cutting line T defined by the selfsame blade.

In accordance with the foregoing, each cutter 15 comprises an uneven number of blades 43 overall. In particular, each cutter 15 comprises a total number of blades 43 equal to the number of first plugs 7*a* and 8*a*, or of second plugs 7*b* and 8*b*, minus one.

In the case of the embodiment described and illustrated in FIGS. 1, 3, 4 and 6*c*, the filter sticks 10 and 13 are divided by each cutter 15 into six plugs 7 and 8 utilizing five blades 43. More exactly, the sticks 10 and 13 are divided by each cutter 15 into three first plugs 7*a* and 8*a* and three second plugs 7*b* and 8*b*.

Generally considered, the blades 43 might all be capable of translating motion, moving as one, or split into a translating set and a fixed set, as illustrated in FIGS. 1, 3, 4 and 6*c*.

Likewise in general, should the sticks 10 and 13 be divided by the cutters 15 into four or more plugs 7 and 8, the cutters 15 could also comprise at least one fixed blade 43*b*.

In this instance, each fixed blade 43*b* will be interposed operationally between two translating blades 43*a*. More precisely, it is the cutting line T defined by the fixed blade 43*b* that will be located between the cutting lines T defined by the translating blades 43*a*.

In the example of FIGS. 1, 3 and 4, the translating blades 43*a* and the fixed blades 43*b* of each cutter 15 are arranged in two separate sets. Moreover, the translating blades 43*a* are positioned upstream of the fixed blades 43*b*.

In an alternative embodiment (not illustrated), the translating blades 43*a* could be positioned downstream of the fixed blades 43*b*.

In the example illustrated (referring to FIG. 4 in particular), each cutter 15 comprises a fixed shaft 44 to which the fixed blades 43*b* are mounted, and a translating shaft 45 to which the translating blades 43*a* are mounted. Each fixed shaft 44 and each translating shaft 45 is coupled to a respective motor (not shown in the accompanying drawings), by which the shaft and the associated blades 43 are set in rotation.

According to the present invention, correction means 42 comprise at least one actuator 46 associated with each translating shaft 45 of each cutter 15. The actuator 46 is coupled to each translating shaft 45 and able thus to displace both the shaft and the translating blades 43*a*, thereby altering the position of the respective cutting lines T. The actuator 46 can be hydraulic or pneumatic in operation, by way of example.

Adopting an alternative embodiment, illustrated in FIG. 5, all the blades 43 of the cutter are mounted to a single translating shaft 47.

In operation, referring to the embodiment shown in FIGS. 1, 3, 4 and 6*c*, the two fixed cutting lines T are alternated with the three translatable, or rather, adjustable cutting lines T. In particular, one adjustable cutting line T is aligned centrally on the filter stick 10 and 13, whilst the other two adjustable cutting lines T are located toward the ends of the stick 10 and 13.

Figure 6A:
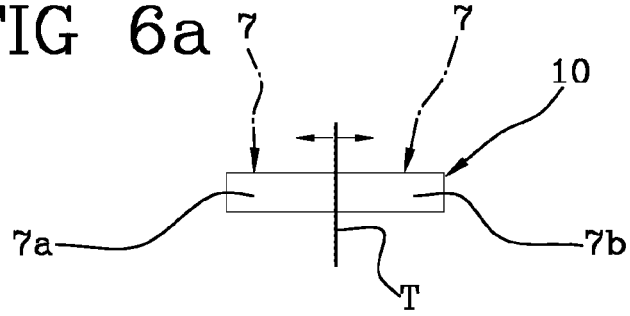
FIGS. 6*a* . . . 6*d* are diagrams illustrating the operation of the machine in FIG. 1.
Figure 6B:
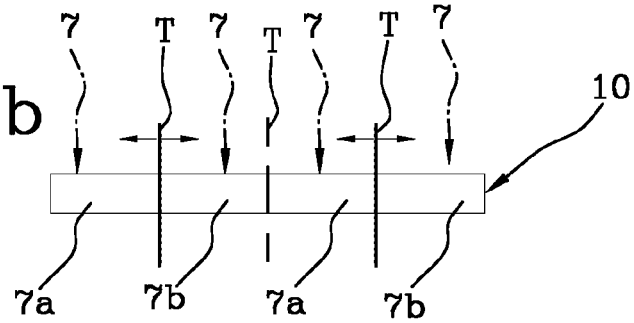
Figure 6C:
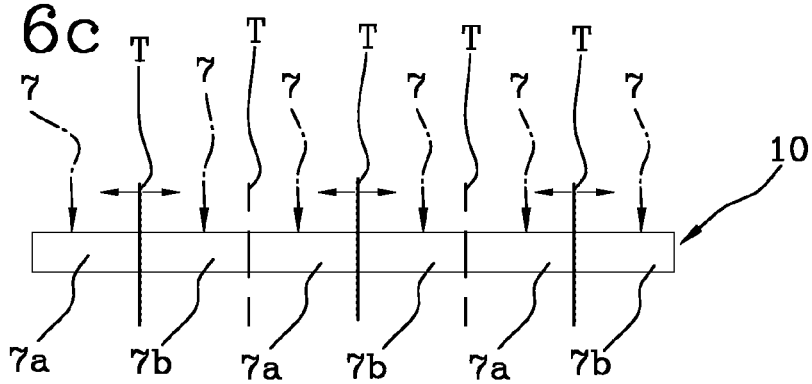
Figure 6D:
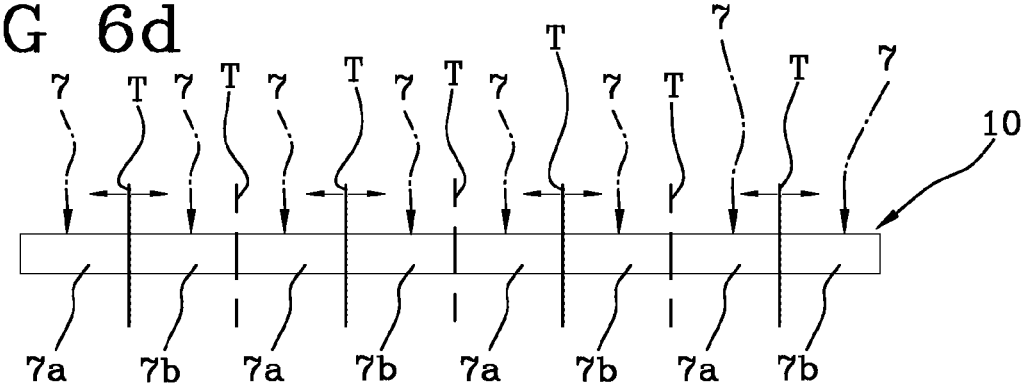

Observing FIG. 6*c*, a displacement of the adjustable cutting line T to the left has the effect of shortening the first plugs 7*a* and lengthening the second plugs 7*b*.

Conversely, a displacement of the adjustable cutting line T to the right has the effect of lengthening the first plugs 7*a* and shortening the second plugs 7*b*.

Any such corrective action will impact on the relative positioning of the filter groups 6, once the plugs 7*a* and 7*b* of corrected length reach the garniture tongue on which the respective rods 26*a* and 26*b* are formed.

Self-evidently, the correction can be applied to the first sticks 10 only, to the second sticks 13 only, or to both.

The machine 1 described above is designed, in operation, to implement a method of manufacturing composite filters for cigarettes, cigars or similar products, according to the invention. The method in question includes the steps of:

- generating a succession of filter sticks 10 of a first type, made from a first filter material and/or having first filtration properties, and at least one other succession of filter sticks 13 of a different type, made from a respective different filter material and/or having filtration properties different to those of the first type;
- cross-cutting the filter sticks 10 of the first type and the filter sticks 13 of the different type on at least one transverse cutting line T to obtain a succession of first and second plugs 7*a* and 7*b* of the first type and a succession of first and second plugs 8*a* and 8*b* of the different type;
- arranging the first plugs 7*a* of the first type and the first plugs 8*a* of the different type alternately one with another to create a first filter rod 26*a*, and arranging the second plugs 7*b* of the first type and the second plugs 8*b* of the different type alternately one with another to create a second filter rod 26*b;*
- checking the position of at least one first plug 7*a* and 8*a* of the first filter rod 26*a*, relative to a corresponding second plug 7*b* and 8*b* of the second filter rod 26*b;*
- correcting the position of the at least one transverse cutting line T according to the relative positioning of the selfsame first and second plugs.

In an alternative embodiment (not illustrated), the machine 1 could comprise a third feed hopper (not illustrated) supplying a succession of filter sticks of a third type, having properties different to the properties both of the first type and of the second or further type.

The third feed hopper will be associated with a third pick-up roller (not illustrated), similar to the first pick-up roller 11 and the second pick-up roller 14 described previously.

Associated with the third pick-up roller will be a further cutter (not illustrated), by which the sticks of the third type are divided on at least one cutting line to obtain a further succession of sticks.

In practice, the correction described above can be can be applied to sticks of the first type only, to sticks of the second type only, to sticks of the third type only, to all the sticks, or to sticks of two types only.

The object stated at the outset is achieved by the present invention. In effect, should the manufacture of composite filters be affected by systematic and cumulative errors, the error can be corrected by varying the length of the corresponding filter plugs making up the two continuous filter rods. In other words, when a systematic error is detected, it can be remedied by varying the position of the cutting lines, and in particular by repositioning the cutters.

The invention claimed is:

1. A twin track machine for manufacturing composite filters attachable to cigarettes, cigars and the like, typically filters composed of at least two filter plugs made from different materials and/or with different filtration properties, comprising:

first feed means by which filter sticks of a first type made from a first filter material and/or with first filtration properties are directed in succession along a respective first path;

at least second feed means by which filter sticks of a respective different type, made from a different filter material and/or with filtration properties different to those of the first type, are directed in succession along a respective second path;

first cutting means positioned along the first path, by which each filter stick of the first type is cross-cut on at least one transverse cutting line and separated thus into first and second plugs, arranged alternately and end to end; the first plugs of the first type destined to form part of a first continuous filter rod and the second plugs of the first type destined to form part of a second continuous filter rod;

at least second cutting means positioned along the second path, by which each filter stick of the different type is cross-cut on at least one transverse cutting line and separated thus into first and second plugs, arranged alternately and end to end; the first plugs of the different type destined to form part of the first continuous filter rod and the second plugs of the different type destined to form part of the second continuous filter rod;

conveying and assembling means by which the first plugs of the first type and of the different type are taken up, ordered and advanced longitudinally, end-to-end and in alternation, along the track on which the first filter rod is formed, and by which the second plugs of the first type and of the different type are taken up, ordered and advanced longitudinally, end-to-end and in alternation, along the track on which the second filter rod is formed;

control means monitoring the longitudinal position of at least one first plug of the first rod, and of the corresponding second plug of the second rod, one relative to another;

correction means by which the position of the at least one transverse cutting line on the filter sticks of the first type, and/or the position of the at least one transverse cutting line on the filter sticks of different type, can be adjusted according to the relative positioning of the first and second plugs.

2. A machine as in claim 1, wherein the filter sticks are divided by the respective first and second cutting means into an even number of first and second plugs.

3. A machine as in claim 1, wherein the first feed means comprise a first pick-up roller and the second feed means comprise a second pick-up roller; the first cutter means being associated with the first pick-up roller and the second cutter means associated with the second pick-up roller.

4. A machine as in claim 1, wherein at least one of the cutting means comprises at least one translating blade, translatable along a respective filter stick in order to change the position of the respective cutting line.

5. A machine as in claim 1, wherein each of the cutting means comprises a plurality of blades equal in number to the number of first and second plugs, minus one.

6. A machine as in claim 1, wherein at least one of the cutting means comprises a plurality of translating blades, and at least one respective translating shaft on which the translating blades are mounted.

7. A machine as in claim 6, wherein at least one of the cutting means comprises a plurality of fixed blades arranged alternately with the translating blades.

8. A machine as in claim 7, wherein one translatable cutting line is located centrally on the filter stick being cut, whilst another two translatable cutting lines are located at the ends of the filter stick being cut.

9. A machine as in claim 3, comprising means by which to displace the filter sticks axially in relation to the cutting means, wherein such means of displacing the filter sticks axially are associated with the pick-up rollers.

10. A machine as in claim 6, wherein correction means comprise at least one respective actuator coupled to each translating shaft and enabling the translational displacement of the selfsame shaft.

11. A machine as in claim 1, further comprising a processing unit connected to the control means and to the correction means.

12. A method of manufacturing composite filters for cigarettes, cigars and the like, including the steps of:

generating a succession of filter sticks of a first type, made from a first filter material and/or having first filtration properties, and at least one other succession of filter sticks of a different type, made from a respective different filter material and/or having filtration properties different to those of the first type;

cross-cutting the filter sticks of the first type and the filter sticks of the different type on at least one transverse cutting line to obtain a succession of first and second plugs of the first type and a succession of first and second plugs of the different type;

arranging the first plugs of the first type and the first plugs of the different type alternately one with another to create a first filter rod, and arranging the second plugs of the first type and the second plugs of the different type alternately one with another to create a second filter rod;

checking the position of at least one first plug of the first rod, relative to a corresponding second plug of the second rod;

correcting the position of the at least one transverse cutting line according to the relative positioning of the selfsame first and second plugs.

* * * * *